US009403543B2

(12) United States Patent
Smith et al.

(10) Patent No.: US 9,403,543 B2
(45) Date of Patent: Aug. 2, 2016

(54) TRAIN SUSPENSION SYSTEM

(71) Applicants: Cambridge Enterprise Limited, Cambridge, Cambridgeshire (GB); Loughborough University, Leicestershire (GB)

(72) Inventors: Malcolm C. Smith, Cambridge (GB); Zheng Jiang, Jiang Su (CN); Roger Morgan Goodall, Binbrook (GB)

(73) Assignee: Cambridge Enterprise Limited, Cambridge (GB)

( * ) Notice: Subject to any disclaimer, the term of this patent is extended or adjusted under 35 U.S.C. 154(b) by 33 days.

(21) Appl. No.: 14/164,715

(22) Filed: Jan. 27, 2014

(65) Prior Publication Data

US 2014/0202353 A1 Jul. 24, 2014

Related U.S. Application Data

(63) Continuation of application No. PCT/GB2012/051814, filed on Jul. 27, 2012.

(30) Foreign Application Priority Data

Jul. 27, 2011 (GB) ..... 1112902.0

(51) Int. Cl.
*B61F 5/50* (2006.01)
*B61F 5/22* (2006.01)
*B61F 5/30* (2006.01)

(52) U.S. Cl.
CPC ... *B61F 5/50* (2013.01); *B61F 5/22* (2013.01); *B61F 5/30* (2013.01)

(58) Field of Classification Search
CPC ..... B61F 5/00; B61F 5/02; B61F 5/22; B61F 5/24; B61F 5/38
USPC ..... 105/157.1, 164, 167, 168, 199.1, 453
See application file for complete search history.

(56) References Cited

U.S. PATENT DOCUMENTS 7,316,303 B2 1/2008 Smith
2010/0148463 A1* 6/2010 Wang ..... B60G 13/14 280/124.101

OTHER PUBLICATIONS

Fu-Cheng Wang et al, "The Lateral Stability of Train Suspension Systems Employing Inerters", Vehicle System Dynamics, vol. 48, No. 5, May 2010, 619-643.

(Continued)

*Primary Examiner* — R. J. McCarry, Jr.
(74) *Attorney, Agent, or Firm* — Edell, Shapiro & Finnan LLC.

(57) ABSTRACT

A suspension system for a train vehicle includes at least one inerter to minimize track wear. Track wear may be measured by direct measures such as wear work, or indirect measures such as yaw stiffness. "Minimizing" track wear means that such measures are reduced below values which are achievable with conventional technology while maintaining acceptable values of other performance metrics, such as ride comfort or least damping ratio. The suspension system may comprise at least one damper connected in series with the at least one inerter. The suspension system may be the primary or the secondary suspension system of a train vehicle.

16 Claims, 7 Drawing Sheets

(56) References Cited

OTHER PUBLICATIONS

"High Speed Presentation Wins Award", Loughborough University, School of Electronic, Electrical and Systems Engineering, retrieved from http://www.lboro.ac.uk/departments/el/news/Year2011/Matamoros-Sanchez.html.

International Search Report of the corresponding PCT application No. PCT/GB2012/051814, dated Nov. 28, 2012.

* cited by examiner

Table 1

| Symbol | Parameter | Unit | Nominal value |
|---|---|---|---|
| $V$ | Vehicle speed | $ms^{-1}$ | 1 to 55 |
| $m_w$ | Wheelset mass | kg | 1376 |
| $I_w$ | Wheelset yaw inertia | $kgm^2$ | 766 |
| $m_g$ | Bogie frame mass | kg | 3477 |
| $I_g$ | Bogie frame yaw inertia | $kgm^2$ | 3200 |
| $m_v$ | Half vehicle body mass | kg | 17230 |
| $r_0$ | Wheel radius | m | 0.445 |
| $\lambda$ | Wheel conicity | - | 0.3 |
| $f_{11}$, $f_{22}$ | Longitudinal and lateral creepage coefficients | N | 10e7 |
| $l_{wx}$ | Semi-longitudinal spacing of wheelsets | m | 1.225 |
| $l_{wy}$ | Half gauge of wheelset | m | 0.75 |
| $l_x$ | Semi-lateral spacing of steering linkages and primary longitudinal suspension | m | 1.2 |
| $K_{px}$ | Steering linkage stiffness plus primary longitudinal damping per axle box | $Nm^{-1}$ | $3.766 \times 10^7$ |
| $C_{px}$ | Steering linkage damping plus primary longitudinal damping per axle box | $Nsm^{-1}$ | $1.017 \times 10^4$ |
| $K_{py}$ | Primary lateral stiffness per axle box | $Nm^{-1}$ | $4.71 \times 10^6$ |
| $C_{py}$ | Primary lateral damping per axle box | $Nsm^{-1}$ | $1.2 \times 10^4$ |
| $K_{sy}$ | Secondary lateral stiffness per axle box | $Nm^{-1}$ | $2.45 \times 10^5$ |
| $C_{sy}$ | Secondary lateral damping per axle box | $Nsm^{-1}$ | $2 \times 10^4$ |
| $R_1$, $R_2$ | Radius of curved track at the front and rear wheelsets | m | 1000 |
| $\theta_{c1}$, $\theta_{c2}$ | Cant angle of the curved track at the front and rear wheelsets | rad | $6 \times \pi / 180$ |
| $y_{t1}$, $y_{t2}$ | Straight track lateral stochastic displacement at the front and rear wheelsets | m | - |
| $g$ | Gravity | $ms^{-2}$ | 9.8 |

*FIG. 2*
Prior Art

Prior Art

Table 2

| Layout | Minimised value of $K_{px}$ ($Nm^{-1}$) | Impro. (%) | Parameter values ($Mm^{-1}$, $Nsm^{-1}$, $kg$) |
|---|---|---|---|
| Conventional (opt. over $C_{sy}$, same as default) | $3.77 \times 10^7$ | | $C_{sy} = 2 \times 10^4$ |
| Series $b_{sy}$, $C_{sy}$ (layout S3 in Fig. 2) | $3.53 \times 10^7$ | 6.33 | $C_{sy} = 2.2 \times 10^4$, $b_{sy} = 1.53 \times 10^4$ |
| Conventional (opt. pri. and sec. lateral) | $4.38 \times 10^6$ | 88.4 | $C_{py} = 1 \times 10^6$, $C_{sy} = 2.12 \times 10^4$, $C_{px} = 1 \times 10^3$ |
| Series $b_{py}$, $C_{py}$ *and* $b_{sy}$, $C_{sy}$ (layout S3 in Figs. 2 and 3) | $4.12 \times 10^6$ | 89 | $C_{py} = 7.17 \times 10^5$, $b_{py} = 2.38 \times 10^4$, $C_{sy} = 2.16 \times 10^4$, $b_{sy} = 3.06 \times 10^4$, $C_{px} = 1.5 \times 10^3$ |

*FIG. 6*

TRAIN SUSPENSION SYSTEM

CROSS REFERENCE TO RELATED APPLICATIONS

This application is a continuation of International Application No. PCT/GB2012/051814, filed on Jul. 27, 2012, entitled "Train Suspension System," which claims priority under 35 U.S.C. §119 to Application No. GB 1112902.0 filed on Jul. 27, 2011, entitled "Train Suspension System," the entire contents of each of which are hereby incorporated by reference.

FIELD OF THE INVENTION

The present invention generally relates to a suspension system for a train vehicle and particularly to a suspension system for a train vehicle designed to reduce track wear.

BACKGROUND

It is well known that the forward speed of trains is restricted by the "hunting" motion, which corresponds to the lateral vibration of trains running at high speed. Therefore, trains have an upper speed limit, called the "critical speed." Several attempts have been made in the past to increase the critical speed of trains. For example, Wang, Fu-Cheng and Liao, Min-Kai (2010) "The lateral stability of train suspension systems employing inerters," Vehicle System Dynamics, 38:5, 619 have attempted to improve the critical speed by using "inerters" in the railway suspension systems.

An "inerter," as disclosed for example in U.S. Pat. No. 7,316,303B, represents a mechanical two-terminal element configured to control the mechanical forces at the terminals such that they are proportional to the relative acceleration between the terminals. The inerter, together with a spring and a damper, provides a complete analogy between mechanical and electrical elements, which allows arbitrary passive mechanical impedances to be synthesized. Inerters have been increasingly used in mechanical systems such as car suspension systems to improve system performance.

A disadvantage of conventional train suspension system is that there is a tight trade-off between track wear and other important performance measures. Track wear is dangerous as it has been the cause of major train accidents and requires costly critical maintenance of the railway systems. In the United Kingdom, for example, 923 million GB pounds were spent on track renewals during 2007-2008. This procedure is not only costly but causes significant disruption to the train schedules and passenger's travel.

The present invention seeks to overcome the drawbacks of the prior art and reduce track wear.

SUMMARY

According to the present invention there is provided a suspension system for a train vehicle comprising at least one inerter, such that, in use, track wear is minimized. According to the present invention, there is also provided a method of reducing track wear, the method comprising the step of providing a suspension system for a train vehicle comprising at least one inerter, such that track wear is minimized. Track wear may be measured by direct measures such as wear work, or indirect measures such as yaw stiffness, for example.

'Minimizing' track wear means that such measures are reduced below values which are achievable with conventional technology while maintaining acceptable values of other performance metrics, such as, for example, ride comfort or least damping ratio. For example, according to the present invention, inerters may be used to minimize yaw stiffness.

Preferably, the performance metrics have predetermined ranges. Some examples of "acceptable values" of the maximum lateral body acceleration, Macc, which represents ride comfort and of the least damping ratio will be given below. However, it will be appreciated that "acceptable values" as well as relevant performance metrics may vary according to the use and type of railway vehicle.

Minimizing yaw stiffness reduces excess wheel-rail forces, thereby improving railway vehicle curving performance, i.e., reducing or preventing rolling contact fatigue (RCF). This has the effect of reducing loads upon the track components in general, reducing the level of routine track maintenance and, eliminating the need for major track renewals.

The suspension system may further comprise at least one damper connected to the at least one inerter. In preferred embodiments, the suspension system comprises an inerter in series with a damper. The suspension system according to the present invention may be a lateral, primary or secondary, suspension system. A "lateral" suspension system transmits forces perpendicular to the longitudinal direction (the direction of travel along the track). A "primary" suspension system comprises connections between wheelset axles and a bogie, while a "secondary" suspension system comprises connections between the vehicle body and the bogie.

BRIEF DESCRIPTION OF THE DRAWINGS

Specific examples of the invention will now be described in greater detail with reference to the following figures in which:

FIG. 2 is a table listing parameters and default settings of a 7-degrees of freedom model of the train system shown in FIG. 1;

FIG. 6 is a table listing results for minimizing the yaw stiffness;

DETAILED DESCRIPTION

Figure 1:
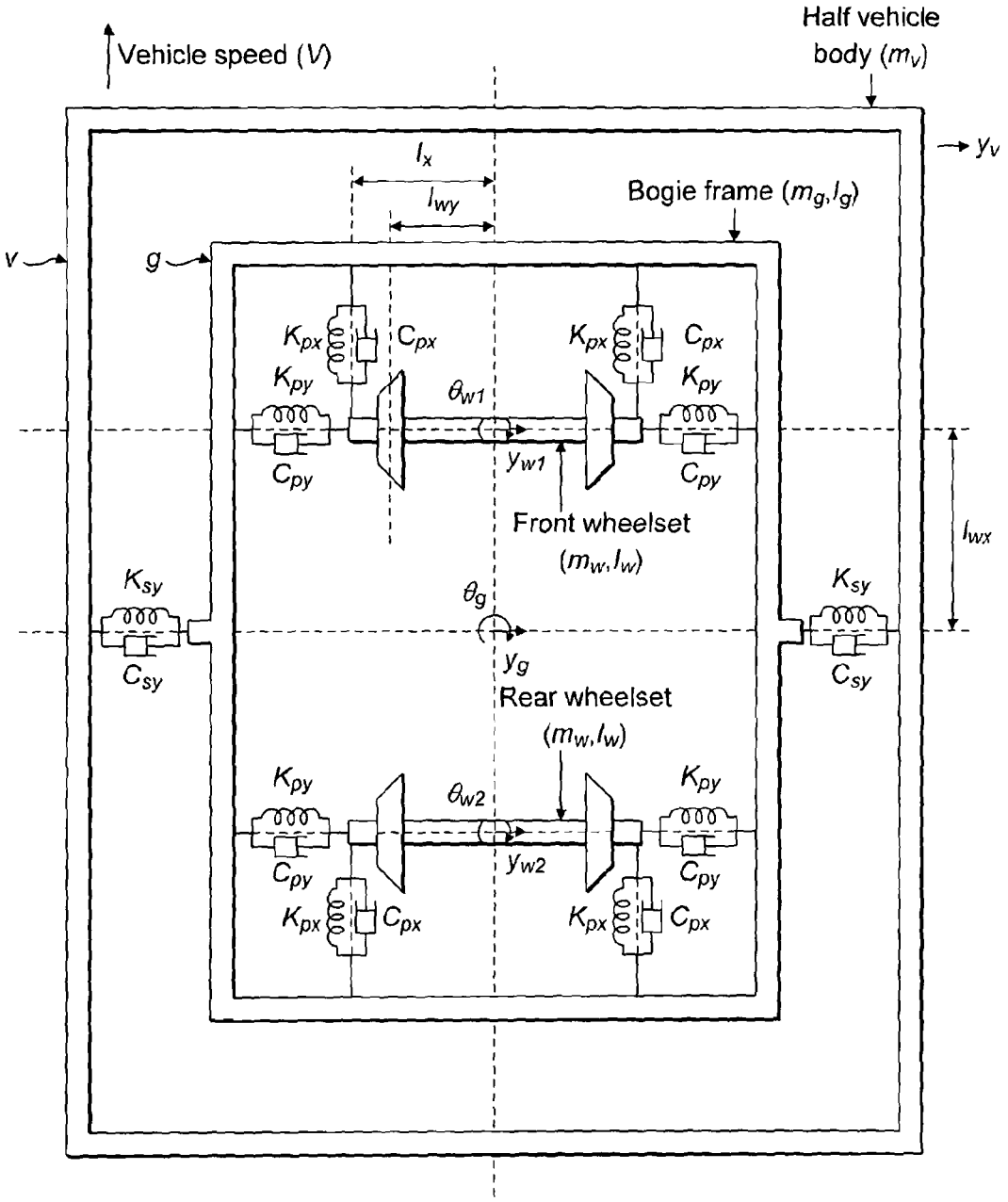
FIG. 1 Prior Art
FIG. 1 represents a plan view of a conventional train system.

FIG. 1 represents a conventional train system 1 comprising a vehicle body v, one bogie frame g, and two solid axle wheelsets w, wherein each wheelset comprises two wheels either side of the axle. The body v is equivalent to the body of half a vehicle or carriage in a high speed train vehicle. The bogie g is used to carry and guide the body along a track or line. Bogies have traditionally been used in train designs as a "cushion" between vehicle body and wheels to reduce the vibration experienced by passengers or cargo as the train moves along the track.

The wheelsets w and bogie g are connected by a primary suspension system $K_p/C_p$. Only longitudinal (x direction) and lateral (y direction) connections are represented in FIG. 1. Any suitable suspension system may be used, such as a steel coil or steel plate framed bogie g with laminated spring axle-box suspension. The (lateral and longitudinal) connections of the primary suspension system $K_p/C_p$ are represented by equivalent 'spring-damper' circuits, each circuit comprising a spring of stiffness $K_p$ in parallel with a damper of damping constant $C_p$.

A secondary suspension system $K_s/C_s$ is included between the body v and the bogie g, e.g., making use of an air suspension. The secondary suspension system $K_s/C_s$ may also be represented by equivalent "spring-damper" circuits, wherein each circuit comprises a spring $K_s$ in parallel with a damper $C_s$.

Accordingly, the train system 1 shown in FIG. 1 represents an example of a "two stage suspension system," which includes a primary suspension system and a secondary suspension system. It will be appreciated, however, that the train system may be a "single stage suspension system," which includes a single suspension system between the body and the wheelsets.

The longitudinal connections in the system of FIG. 1 contribute to the yaw modes and only these contributions are accounted for in the model described below. Vertical, longitudinal and roll modes are not included in this model.

The conventional train system 1 of FIG. 1 may be described by a seven degrees-of freedom (7-DOF) model including lateral and yaw modes for each wheelset ($y_{w1};\theta_{w1};y_{w2};\theta_{w2}$) and for the bogie frame ($y_g;\theta_g$), and a lateral mode for the vehicle body ($y_v$). System 1 may be modeled by Eqs. (1)-(7) listed below, with parameters defined in Table 1 shown in FIG. 2:

$$m_w\ddot{y}_{w1} = 2K_{py}(y_g - y_{w1}) + 2C_{py}(\dot{y}_g - \dot{y}_{w1}) - \frac{2f_{22}}{V}\dot{y}_{w1} + 2f_{22}\theta_{w1} + 2K_{py}l_{wx}\theta_g + 2C_{py}l_{wx}\dot{\theta}_g + m_w\left(\frac{V^2}{R_1} - g\theta_{c1}\right), \quad (1)$$

$$I_w\ddot{\theta}_{w1} = -\frac{2f_{11}l_{wy}^2}{V}\dot{\theta}_{w1} - \frac{2f_{11}\lambda l_{wy}}{r_0}y_{w1} + 2K_{px}l_x^2(\theta_g - \theta_{w1}) + 2C_{px}l_x^2(\dot{\theta}_g - \dot{\theta}_{w1}) + \frac{2f_{11}l_{wy}^2}{R_1} - \frac{2f_{11}\lambda l_{wy}}{r_0}y_{t1} + \frac{2K_xl_{wx}l_x^2}{R_1}, \quad (2)$$

$$m_w\ddot{y}_{w2} = 2K_{py}(y_g - y_{w2}) + 2C_{py}(\dot{y}_g - \dot{y}_{w2}) - \frac{2f_{22}}{V}\dot{y}_{w2} + 2f_{22}\theta_{w2} - 2K_{py}l_{wx}\theta_g - 2C_{py}l_{wx}\dot{\theta}_g + m_w\left(\frac{V^2}{R_2} - g\theta_{c2}\right), \quad (3)$$

$$I_w\ddot{\theta}_{w2} = -\frac{2f_{11}l_{wy}^2}{V}\dot{\theta}_{w2} - \frac{2f_{11}\lambda l_{wy}}{r_0}y_{w2} + 2K_{px}l_x^2(\theta_g - \theta_{w2}) + 2C_{px}l_x^2(\dot{\theta}_g - \dot{\theta}_{w2}) + \frac{2f_{11}l_{wy}^2}{R_2} - \frac{2f_{11}\lambda l_{wy}}{r_0}y_{t2} - \frac{2K_xl_{wx}l_x^2}{R_2}, \quad (4)$$

$$m_g\ddot{y}_g = 2K_{py}(y_{w1} - y_g) + 2K_{py}(y_{w2} - y_g) + 2C_{py}(\dot{y}_{w1} - \dot{y}_g) + 2C_{py}(\dot{y}_{w2} - \dot{y}_g) + 2K_{sy}(y_v - y_g) + 2C_{sy}(\dot{y}_v - \dot{y}_g) + m_gV^2\left(\frac{1}{2R_1} + \frac{1}{2R_2}\right) - m_gg\left(\frac{\theta_{c1}}{2} + \frac{\theta_{c2}}{2}\right), \quad (5)$$

-continued $$I_g\ddot{\theta}_g = 2K_{py}l_{wx}(y_{w1} - y_g) + 2K_{py}l_{wx}(y_g - y_{w2}) + 2C_{py}l_{wx}(\dot{y}_{w1} - \dot{y}_g) + 2C_{py}l_{wx}(\dot{y}_g - \dot{y}_{w2}) + 2K_{px}l_x^2(\theta_{w1} - \theta_g) + 2K_{px}l_x^2(\theta_{w2} - \theta_g) + 2C_{px}l_x^2(\dot{\theta}_{w1} - \dot{\theta}_g) + 2C_{px}l_x^2(\dot{\theta}_{w2} - \dot{\theta}_g) - 4K_{py}l_{wx}^2\theta_g - 4C_{py}l_{wx}^2\dot{\theta}_g - \frac{2K_xl_{wx}l_x^2}{R_1} + \frac{2K_xl_{wx}l_x^2}{R_2}, \quad (6)$$

$$m_v\ddot{y}_v = 2K_{sy}(y_g - y_v) + 2C_{sy}(\dot{y}_g - \dot{y}_v) + m_vV^2\left(\frac{1}{2R_1} + \frac{1}{2R_2}\right) - m_vg\left(\frac{\theta_{c1}}{2} + \frac{\theta_{c2}}{2}\right), \quad (7)$$

A state-space form can be derived from equations (1)-(7) as given by:
where $$x=[\check{y}_{w1}, y_{w1}, \check{\theta}_{w1}, \theta_{w1}, \hat{y}_{w2}, y_{w2}, \theta_{w2}, \theta_{w2}, \hat{y}_g, y_g, \check{\theta}_g, \theta_g, \check{y}_v, y_v]^T.$$

$$w=[1/R_1, \theta_{c1}, y_{t1}, 1/R_2, \theta_{c2}, y_{t2}]^T.$$

The vector w is used to define the inputs from the railway track (curvature, cant and track lateral stochastic displacement). When entering a curve, the track cannot change from straight to the nominal value of the radius ($R_1;R_2$) and cant angle ($\theta_{c1};\theta_{c2}$) immediately. A conservative assumption is made in that $R_1;R_2$ and $\theta_{c1};\theta_{c2}$ are ramped with 3 seconds transition time. In fact, for high speed trains a longer transition time is appropriate depending on the vehicle and track type. The straight track lateral stochastic inputs ($y_{t1};y_{t2}$) are of a broad frequency spectrum with a relatively high level of irregularities.

In the example provided below, $y_{t1}$ (t) is defined to be the output of a second order filter H (s)=(21.69 $s^2$+105.6s + 14.42)/($s^3$+30.64$s^2$+24.07s) whose input is a process with a single sided power spectrum given by:

$$S_s(f_s)=A_v/(f_s)^2$$

in which $A_v$ is the track roughness factor, $f_s$ is a spatial frequency in cycles/meter. The body lateral acceleration is quantified in terms of the root mean square (r.m.s.) acceleration J1, and evaluated using the covariance method, time domain simulation method and frequency calculation method. The results by the three methods are all consistent. For the frequency calculation, $J_1$ is expressed by:

$$J_1^2 = \int_0^\infty (G_{\dot{y}_{t1}}(j2\pi f)H(j2\pi f)(1 + e^{-j2\pi fT_d}))^2\dot{S}_z\,df, \approx \Delta f\dot{S}_z\sum_{f=0.01}^{20\,Hz}(G_{\dot{z}_{t1}}(j2\pi f)H(j2\pi f)(1 + e^{-j2\pi fT_d}))^2,$$

where $$\dot{S}_z = \frac{(2\pi)^2A_vV^2}{f}, \ (\mathrm{ms}^{-1})^2(\mathrm{Hz})^{-1},$$

$T_d$ is the time delay of the track input between the front and rear wheelsets, which equals $21_{wx}/V$ seconds, where $1_{wx}$ is the semi-longitudinal spacing of the wheels and V is the system's speed in the longitudinal direction x.

A nominal speed V is assumed to be equal to 55 m/s. Using the default suspension layout and parameter settings, with velocity V varying between 1 m/s and 55 m/s, it can be calculated that the least damping ratio (Ldmp) equals 6.45% (which is achieved at the nominal speed). Using the covariance method, it can also be calculated that, with $y_{t1}$ and $y_{t2}$ as input, the maximum lateral body acceleration (Macc) equals 0.2204 m/s$^2$ when the velocity equals 55 m/s.

Recent investigations (see for example Ingenia online, "Why railscrack," Andy Doherty, Steve Clark, Robert Care and Mark Dembosky, Issue 23 June 2005) have shown that the main cause for track wear is the phenomenon called rolling contact fatigue (RCF) which occurs in bodies in rolling contact. Such bodies can damage one another in various ways depending upon the severity of the contact pressure and the shear in the area where the bodies come into contact. In the case of railway systems, RCF is primarily due to excess wheel—rail forces. These are primarily caused by the axle shifting relative to the rail.

Excess wheel-rail forces in train systems such as the system 1 shown in FIG. 1 are directly related to high values of the primary longitudinal spring stiffness $K_{px}$, which provides high yaw stiffness. High yaw stiffness $K_{px}$ gives good high speed stability but results in very high creep forces that are responsible for RCF.

Apart from yaw stiffness, there are direct measures of track wear such as the wear work which is a measure of energy dissipated at the wheel-rail interface. To reduce track wear, a system according to the present invention uses inerters in the lateral suspensions. This has the effect of reducing track wear by reducing, for example, yaw stiffness $K_{px}$, as will be described below.

Figure 3:
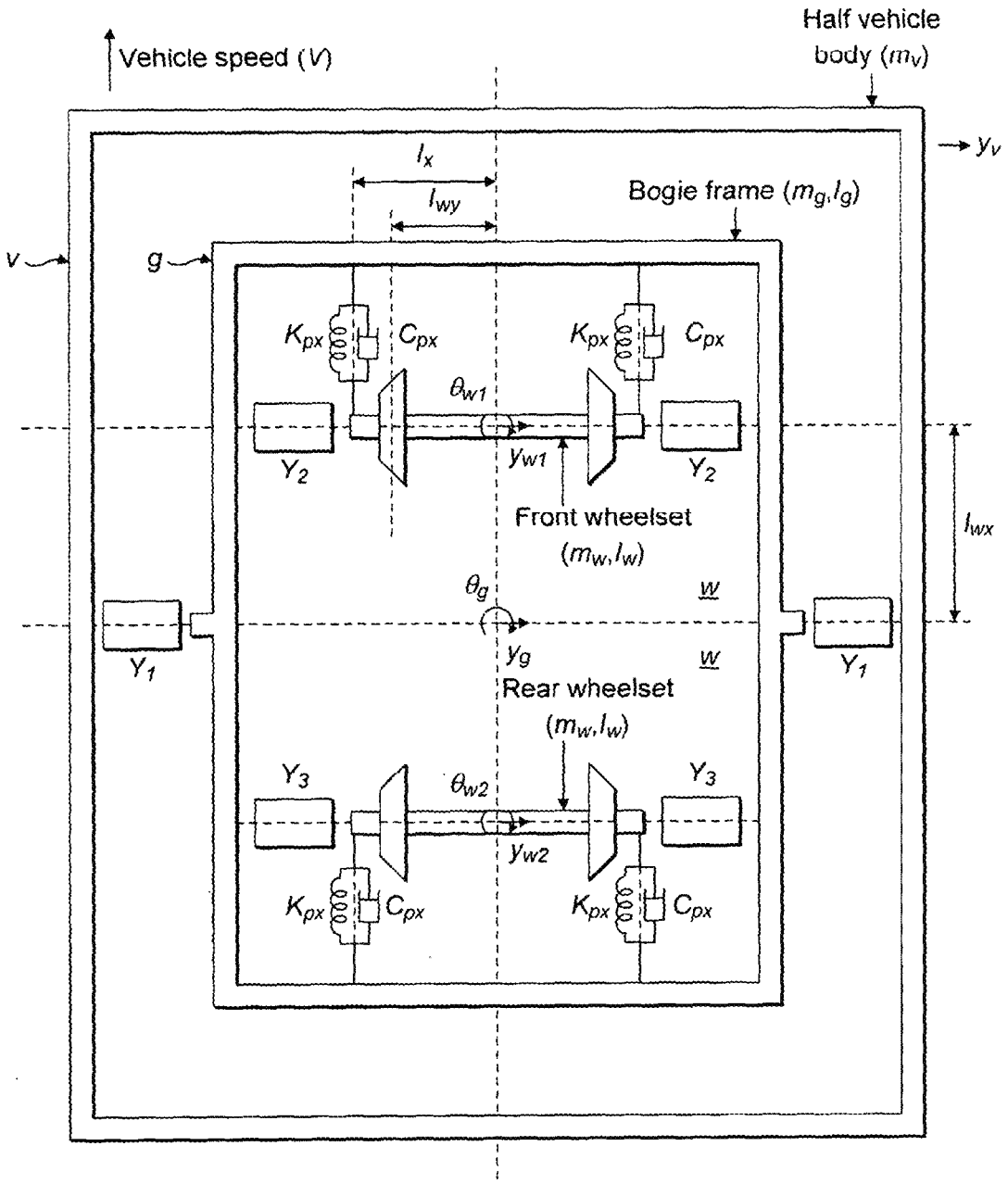
FIG. 3 represents a plan view of a system in accordance with the present invention, in which the primary and secondary lateral suspensions Y1, Y2 and Y3 are mechanical networks comprising inerters as shown in FIGS. 4(*b*), 4(*c*) and FIGS. 5(*b*), 5(*c*)

In accordance with the present invention, the system 2 of FIG. 3 comprises the same elements of the conventional system 1 of FIG. 1 described above (see also FIGS. 4(*a*) and 5(*a*)), and additionally comprises inerter devices b in the lateral connections of the primary and/or secondary suspension systems (in the y direction) as shown in FIGS. 4(*b*), 4(*c*), 5(*b*), and 5(*c*). In its most general form, an "inerter" represents a mechanical two-terminal element comprising means connected between the terminals to control the mechanical forces at the terminals such that they are proportional to the relative acceleration between the terminals. Inerters are defined by the following equation:

$$F = b\frac{d(v_2 - v_1)}{dt},$$

where F is the applied force and b is either a fixed term or a variable function representing the 'inertance' of the system; v1 and v2 are the corresponding velocities of the two terminals.

In the 7-DOF model defined above according to equations (1)-(7), the yaw stiffness $K_{px}$ is minimized. The restrictions are for Ldmp to be above 5% across all velocity values (1-55 m/s) and Macc to be at least as good as the nominal value (0.2204 m/s$^2$). The primary and secondary lateral spring stiffness ($K_{py}$, $K_{sy}$) is fixed, and the optimization is made firstly for the secondary lateral suspension only and then for both the primary and secondary suspensions. Results for a conventional system 1 (without inerters) as shown in FIG. 1 are compared with results obtained for a system 2 in accordance with the present invention. These results show that a 6% improvement in the value of $K_{px}$ can be obtained by using the inerter devices. All parameter values have been constrained to be within physically reasonable ranges, e.g., the values of spring stiffness cannot be arbitrarily large.

Figure 4A:
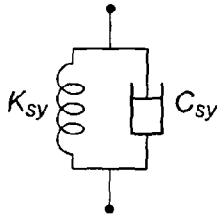
FIG. 4(*a*) shows the conventional suspension layout, and FIGS. 4(*b*) and 4(*c*) show suspension layouts incorporating an inerter $b_{sy}$ for the secondary suspension Y1.
Figure 4B:
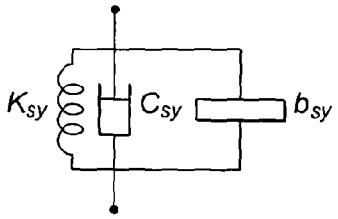
Figure 4C:
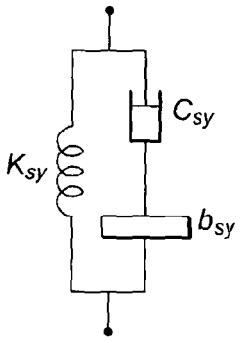
FIG. 4(c) Prior Art
Figure 7A:
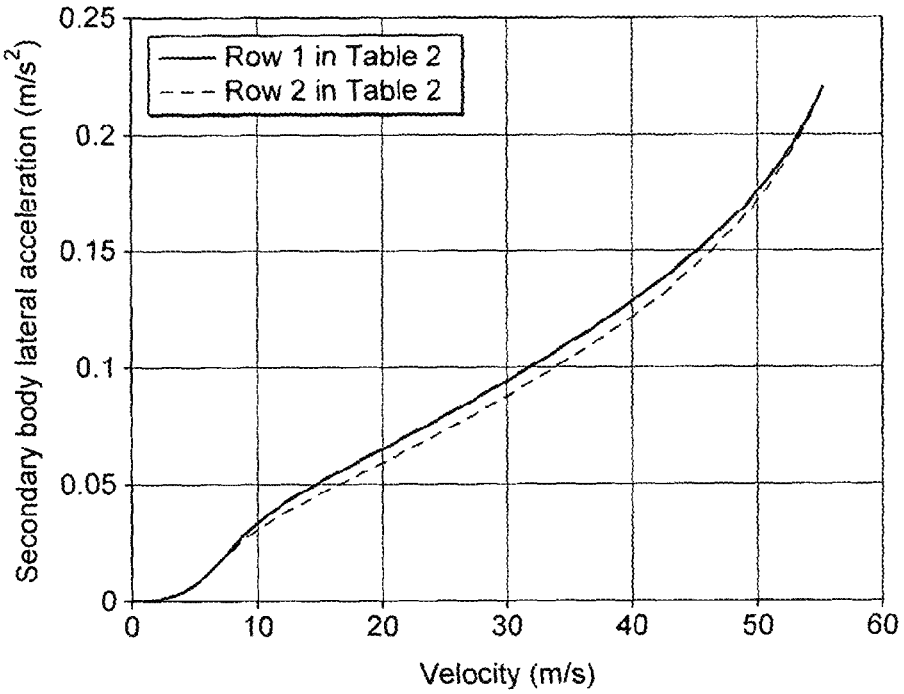
FIG. 7(*a*) is a graph showing the lateral body acceleration, and FIG. 7(*b*) is a graph showing the least damping ratio against velocity for the schemes of the rows 1 and 2 of the table shown in FIG. 6.
Figure 7B:
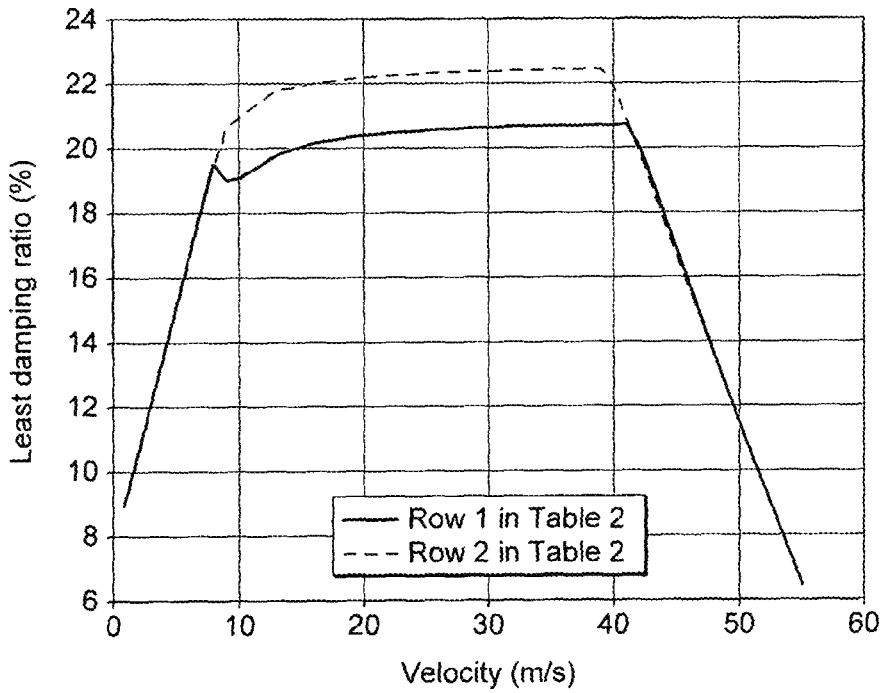

FIGS. 7(*a*) and 7(*b*) show the lateral body acceleration (Macc) and least damping ratio (Ldmp) as a function of velocity for the optimization only including the secondary lateral suspensions. The continuous curves represent the conventional system system 1, as shown in FIG. 1 (without inerters). The dashed curves represent system 2 in accordance with the present invention as shown in FIG. 4(*c*).

Figure 5A:
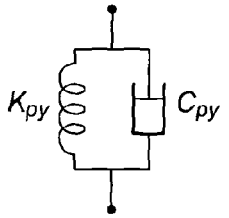
FIG. 5(*a*) shows the conventional suspension layout, and FIGS. 5(*b*) and 5(*c*) show suspension layouts incorporating an inerter $b_{py}$ for the primary suspensions Y2 and Y3.
Figure 5B:
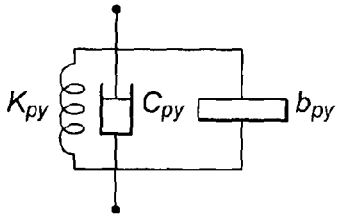
Figure 5C:
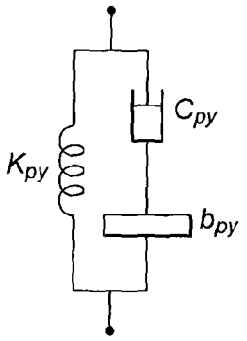
Figure 8A:
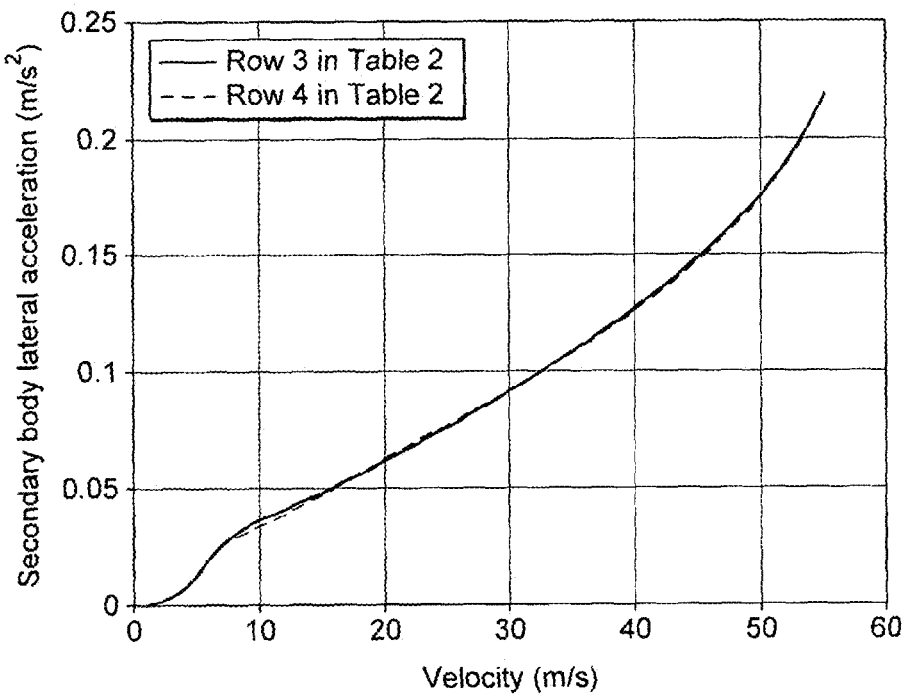
FIG. 8(*a*) is a graph showing the lateral body acceleration, and FIG. 8(*b*) is a graph showing the least damping ratio against velocity for the schemes of rows 3 and 4 of the table shown in FIG. 6.
Figure 8B:
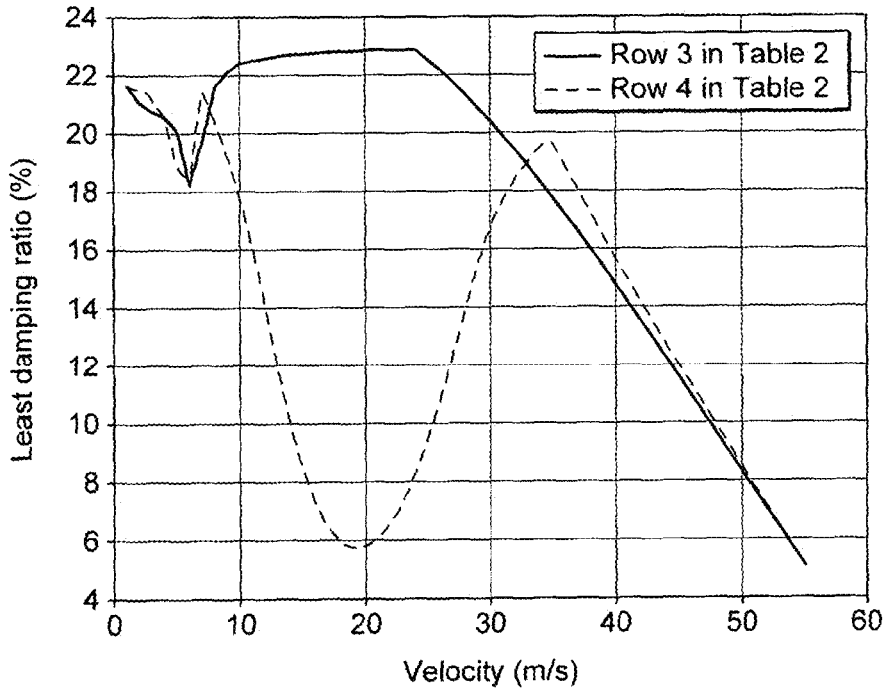

FIGS. 8(*a*) and 8(*b*) show the lateral body acceleration (Macc) and the least damping ratio (Ldmp) as a function of velocity for the optimization involving both the primary and secondary lateral suspensions. The continuous curves represent the conventional system 1, as shown in FIG. 1 (without inerters). The dashed curves represent system 2 in accordance with the present invention as shown in FIG. 4(*c*) and FIG. 5(*c*). From FIGS. 5(*a*)-5(*c*) and FIG. 6, it can be seen that the constraints on Ldmp and Macc are all satisfied (Ldmp is above 5% and Macc is at least as good as the nominal value 0.2204 m/s$^2$).

Preferably, a system 2 in accordance with the invention comprises at least one series damper-inerter system in the lateral primary or secondary suspension system. However, it will be appreciated that it is possible to have many combinations of inerters with dampers or other mechanical parts of the lateral suspension systems. Embodiments in accordance with the invention may comprise inerter-damper combinations at one or more connection points between the wheelsets w and bogie g, as well as between the bogie and body v shown in FIG. 3.

What is claimed is:

1. A mechanical suspension system for a train vehicle comprising at least one inerter, wherein the inerter is a mechanical device connected between two mechanical terminals to provide an equal and opposite force on the terminals which is proportional to relative acceleration between the terminals, wherein the inerter allows yaw stiffness of the train vehicle suspension to be reduced with maximum and minimum acceptable values on standard performance metrics for the train vehicle being satisfied, the performance metrics including at least one of maximum acceptable value of lateral body acceleration and minimum acceptable value of least damping ratio of the mechanical suspension system among all modes of the system.

2. The suspension system according to claim 1, further comprising at least one damper connected to the at least one inerter.

3. The suspension system according to claim 2, wherein the at least one damper is connected in series with the at least one inerter.

4. The suspension system according to claim 1, wherein the suspension system is a lateral secondary suspension system.

5. The suspension system according to claim 1, wherein the suspension system is a lateral primary suspension system.

6. The suspension system according to claim 1, wherein the lateral body acceleration is less than 2 m/s$^2$.

7. The suspension system according to claim 1, wherein the lateral body acceleration is less than 1 m/s$^2$.

8. The suspension system according to claim 1, wherein the lateral body acceleration is less than 0.2204 m/s$^2$.

9. The suspension system according to claim 1, wherein the least damping ratio is greater than 5%.

10. The suspension system according to claim 1, wherein the least damping ratio is greater than 1%.

11. The suspension system according to claim 1, wherein the least damping ratio is greater than 0.1%.

12. The suspension system according to claim 1, wherein the minimized yaw stiffness is less than $3.77\times10^7$ N/m.

13. The suspension system according to claim 1, wherein the minimized yaw stiffness is less than $4.38\times10^6$ N/m.

14. The suspension system according to claim 1, wherein the minimized yaw stiffness is less than $4.12\times10^6$ N/m.

15. A train vehicle comprising a suspension system according to claim 1.

16. A method of reducing track wear, the method comprising providing a mechanical suspension system for a train vehicle comprising at least one inerter, wherein the inerter is a mechanical device connected between two mechanical terminals to provide an equal and opposite force on the terminals which is proportional to relative acceleration between the terminals, wherein the inerter allows yaw stiffness of the train vehicle suspension to be reduced with maximum and minimum acceptable values on standard performance metrics for the train vehicle being satisfied, the performance metrics including at least one of maximum acceptable value of lateral body acceleration and minimum acceptable value of least damping ratio of the mechanical suspension system among all modes of the system.

* * * * *